US008881950B2

(12) United States Patent
Pappalardo

(10) Patent No.: US 8,881,950 B2
(45) Date of Patent: Nov. 11, 2014

(54) MULTIPLE COMPONENT DISPENSING CARTRIDGE, MIXING NOZZLE AND METHOD FOR REDUCING CONTACT BETWEEN FLUIDS

(75) Inventor: Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 450 days.

(21) Appl. No.: 12/917,020

(22) Filed: Nov. 1, 2010

(65) Prior Publication Data

US 2012/0104044 A1 May 3, 2012

(51) Int. Cl.

| | |
|---|---|
| ***B05C 17/005*** | (2006.01) |
| ***B01F 15/02*** | (2006.01) |
| ***B01F 15/00*** | (2006.01) |
| ***B01F 5/06*** | (2006.01) |
| ***B05C 17/01*** | (2006.01) |
| ***B01F 13/00*** | (2006.01) |

(52) U.S. Cl.

CPC ..... *B05C 17/01* (2013.01); *B01F 15/0224* (2013.01); *B05C 17/00559* (2013.01); *B01F 15/0087* (2013.01); *B05C 17/00513* (2013.01); *B01F 5/0615* (2013.01); *B01F 13/0023* (2013.01); *B01F 15/0237* (2013.01); *B05C 17/005* (2013.01)

USPC ..... 222/137; 222/145.6

(58) Field of Classification Search

CPC ..... B05C 17/00516; B05C 17/00553; B05C 17/01; B05C 17/00559

USPC ..... 222/137, 145.5, 145.6, 129.1, 135

See application file for complete search history.

(56) References Cited

U.S. PATENT DOCUMENTS

| | | | | |
|---|---|---|---|---|
| 4,509,690 | A * | 4/1985 | Austin et al. | 239/429 |
| 5,080,262 | A * | 1/1992 | Herold et al. | 222/135 |
| 5,685,639 | A * | 11/1997 | Green | 366/101 |
| 6,394,314 | B1 * | 5/2002 | Sawhney et al. | 222/137 |

(Continued)

FOREIGN PATENT DOCUMENTS

| | | | |
|---|---|---|---|
| DE | 9015118 | U1 | 2/1992 |
| EP | 0378806 | A2 | 7/1990 |
| WO | 2005095225 | A1 | 10/2005 |

OTHER PUBLICATIONS

European Patent Office, European Search Report in EP Application No. 11187383, Oct. 17, 2013.

*Primary Examiner* — Paul R Durand
*Assistant Examiner* — Charles P Cheyney
(74) *Attorney, Agent, or Firm* — Wood, Herron & Evans, L.L.P.

(57) ABSTRACT

A fluid cartridge for mixing and dispensing first and second fluids includes a housing, a piston unit mounted in the housing, and a mixing nozzle. The mixing nozzle includes a first portion releasably attachable to a distal end of the housing and a second portion located distal to the first portion. An internal fluid passage communicates between the first and second portions. A static mixing element is located in the second portion and a distal dispensing opening communicates with the static mixing element. A tubular fluid separator element is located in the first portion and defines first and second flow passages. The first flow passage is a central passage and the second flow passage is radially outside of the first flow passage. The fluid separator element maintains the flow of the first fluid separate from the flow of the second fluid in the first portion of the mixing nozzle.

22 Claims, 7 Drawing Sheets

(56) References Cited

U.S. PATENT DOCUMENTS

| | | | | |
|---|---|---|---|---|
| 6,769,574 | B1 | 8/2004 | Keller | |
| 6,820,766 | B2 | 11/2004 | Keller et al. | |
| 7,306,126 | B2 | 12/2007 | Brugner | |
| 7,464,834 | B2 | 12/2008 | Law et al. | |
| 7,694,853 | B2 | 4/2010 | Keller | |
| 7,748,567 | B2 | 7/2010 | Horner et al. | |
| 2007/0228076 | A1 * | 10/2007 | Horner et al. | 222/135 |

* cited by examiner

MULTIPLE COMPONENT DISPENSING CARTRIDGE, MIXING NOZZLE AND METHOD FOR REDUCING CONTACT BETWEEN FLUIDS

TECHNICAL FIELD

The present invention generally relates to multiple fluid component mixing and dispensing cartridges of the type utilize static mixing nozzles.

BACKGROUND

Various types of multiple component mixing and dispensing devices exist, including those in which the fluid chambers are in a side-by-side configuration, and those in which the fluid chambers are in a coaxial configuration. Such cartridges typically are placed in a hand-held applicator or gun having one or more movable plungers. The plungers move pistons associated with the fluid chambers to dispense and mix the two component fluids at a distal end of the cartridge.

A fluid cartridge of this general type includes respective first and second outlets at the distal end for discharging the two fluids from the fluid chambers into a mixing nozzle. The mixing nozzle includes an internal static mixing element that repeatedly combines layers of the two fluids for mixing purposes. The outlets of the cartridge are in fluid communication and are located adjacent to one another, such as in a coaxial or side-by-side arrangement within a proximal end of the mixing nozzle. Because these outlets are in direct fluid communication with one another when the static mixing nozzle is secured to the distal end of the cartridge, there is the potential for cross contamination of the two fluids within the nozzle at the location of the outlets. These fluids are often reactive with each other, such as in the case of an epoxy resin adhesive in which one of the fluids is a resin component and the other is a catalyst that will cause a chemical reaction and eventual hardening of the mixed fluids. This presents difficulties, such as when reusing the cartridge with the attached mixing nozzle, or when removing and later replacing the used mixing nozzle with a new nozzle. The residual fluids at the location of the cartridge outlets often contact each other, react, and harden to create a clogged condition.

It would therefore be desirable to provide a mixing nozzle for a fluid cartridge and a method that addresses these issues.

SUMMARY

The present invention generally provides a fluid cartridge for mixing and dispensing first and second fluids including a housing, a piston unit, and a mixing nozzle. The housing includes a distal end and first and second fluid chambers configured to hold respective first and second fluids. The first and second fluid chambers respectively communicate with first and second outlets at the distal end of the housing. The piston unit is mounted in the housing and is movable to force the first and second fluids to flow from the first and second chambers out of the first and second outlets. The mixing nozzle includes a first portion releasably attachable to the distal end of the housing and a second portion located distal to the first portion. An internal fluid passage communicates between the first and second portions. A static mixing element is positioned in the second, distal portion and a dispensing opening is located distal to the static mixing element. A tubular fluid separator element is located in the first portion and defines first and second flow passages. The first flow passage is contained in a central tubular portion of the tubular element and communicates with the first outlet and the second flow passage is located radially outside of the central tubular portion and communicates with the second outlet. The tubular fluid separator element maintains the flow of the first fluid separate from the flow of the second fluid in the first portion of the mixing nozzle. In this manner, the first and second fluids do not contact each other on the outlet surface of the distal end of the fluid cartridge housing and are less likely to mix and interact when the mixing nozzle and the included fluid separator element are removed from the distal end of the housing.

The first outlet of the housing may further comprise a tubular outlet member and the central tubular portion of the fluid separator element can releasably couple to the tubular outlet member. More specifically, the central tubular portion of the separator element can include a bore that receives the tubular outlet member of the housing. The bore may be a throughbore along the first flow passage or an annular bore around the first flow passage, as examples. The first flow passage of the fluid separator element may be cylindrical or, as another example, the first flow passage may generally converge in a distal direction. The mixing nozzle may further comprise an internal wall and the fluid separator element can further include a flange that engages the internal wall. The flange includes the second flow passage communicating with the second outlet of the housing. More specifically, this second flow passage may be defined by one or more apertures in the flange.

The invention contemplates a mixing nozzle as generally summarized above, as well as a method for mixing and dispensing first and second fluids from a nozzle adapted to be releasably coupled to a fluid cartridge as generally summarized above or when attached to other types of dispensers, such as meter dispense guns. The method generally includes releasably coupling a first portion of a mixing nozzle to the distal end of the housing. First and second fluids are forced from the first and second outlets of the housing into the first portion of the mixing nozzle. The first and second fluids are maintained physically separate from each other with a fluid separator element located within the first portion of the mixing nozzle and located, at least partially, distal to the first and second outlets. The fluid separator element further comprises a tubular element and the method further comprises directing the first fluid through a central tubular portion of the tubular element, and directing the second fluid along a path radially outside of the central tubular portion. The first and second fluids are delivered through a static mixing element in the second portion of the mixing nozzle located distal to the first portion. The first and second fluids are mixed with the static mixing element. The mixed first and second fluids are discharged through a dispensing opening located distal to the static mixing element.

The method can further comprise removing the mixing nozzle and fluid separator element from the housing with the first and second fluids remaining at least substantially separated. The first outlet of the housing further comprises a tubular outlet member and releasably coupling the first portion of the mixing nozzle to the distal end of the housing further comprises releasably coupling the central tubular portion to the tubular outlet member. More specifically, the central tubular portion may include a bore and releasably coupling the central tubular portion to the tubular outlet member can further comprise inserting the tubular outlet member into the bore with the central tubular member extending distally from the tubular outlet member. Maintaining the first and second fluids physically separate from each other can further comprise directing the first fluid through a converging flow passage, or through a flow passage of another shape in the fluid separator element.

Various additional features and advantages will become apparent upon review of the following detailed description of the illustrative embodiments taken in conjunction with the accompanying drawings.

DETAILED DESCRIPTION OF THE ILLUSTRATIVE EMBODIMENTS

Figure 1:
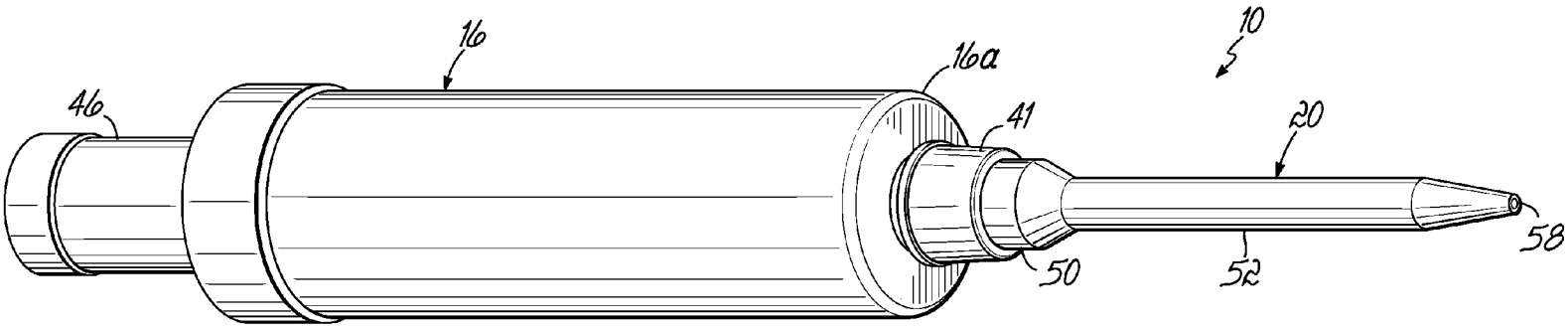
FIG. 1 is a perspective view of a fluid cartridge constructed in accordance with an illustrative embodiment of the invention.
Figure 2:
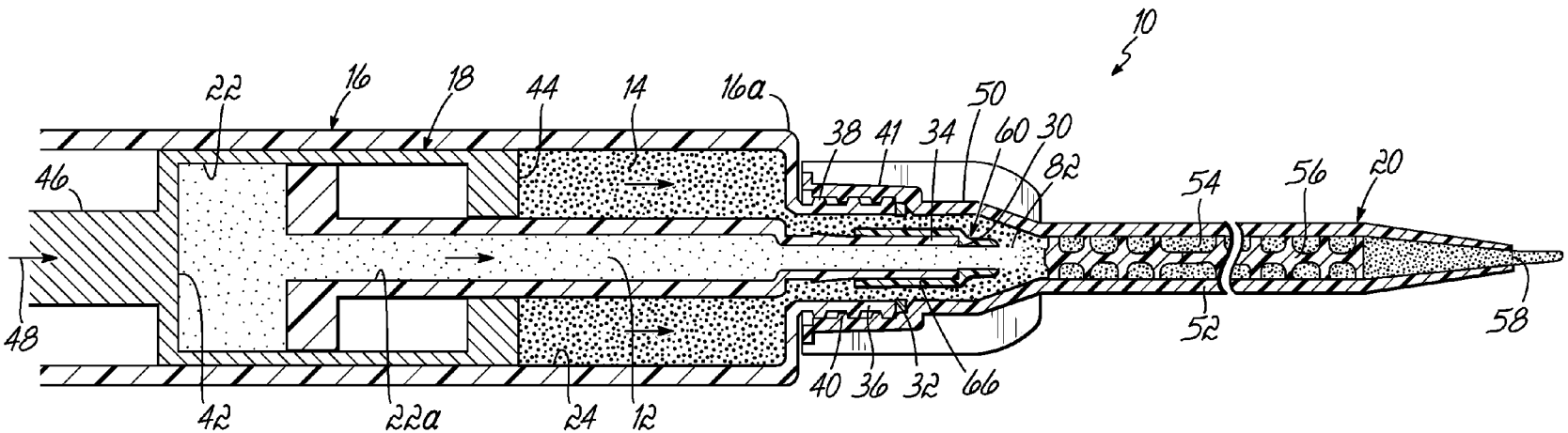
FIG. 2 is a fragmented cross sectional view of the fluid cartridge shown in FIG. 1, taken generally along the central longitudinal axis of the fluid cartridge and illustrating internal components.

Referring first to FIGS. 1 and 2, a fluid cartridge 10 is shown for mixing and dispensing first and second fluids 12, 14, and generally includes a housing 16, a piston unit 18 mounted in the housing 16, and a mixing nozzle 20 coupled to a distal end 16*a* of the housing 16. It will be appreciated that the housing 16 and piston unit 18 may take on many different designs, and the design shown here is for illustrative purposes only. For further details concerning the operation of the piston unit 18, reference may be made to U.S. Pat. No. 7,748,567, the disclosure of which is hereby incorporated by reference herein.

Generally, the housing 16 includes first and second fluid chambers 22, 24 to hold the respective first and second fluids 12, 14. The second fluid chamber 24 is an annular chamber disposed in surrounding relation to a forward or distal section 22*a* of the first chamber 22. The piston unit 18 is configured for movement to force the first and second fluids 12, 14 from the first and second fluid chambers 22, 24 out of respective first and second outlets 30, 32 of the housing 16. The first outlet 30 is located at the distal end of a first tubular outlet member 34 of the housing 16, while the second outlet 32 is located at the distal end of a second tubular outlet member 36 concentric with the first tubular outlet member 34 and coupled for fluid communication with the second fluid chamber 24. This latter tubular outlet member 36 includes external threads 38 that couple with internal threads 40 within a proximal attaching element 41 of the static mixing nozzle 20. The piston unit 18 more specifically comprises a first piston 42 and a second piston 44 for respectively forcing the first and second fluids 12, 14 out of the first and second fluid chambers 22, 24. This piston unit 18 is operated by providing a motive force, such as with a hand-operated applicator (not shown) to a plunger element 46 in the direction of the arrow 48 shown in FIG. 2, and as more particularly described in the above-incorporated U.S. Pat. No. 7,748,567.

Figure 3A:
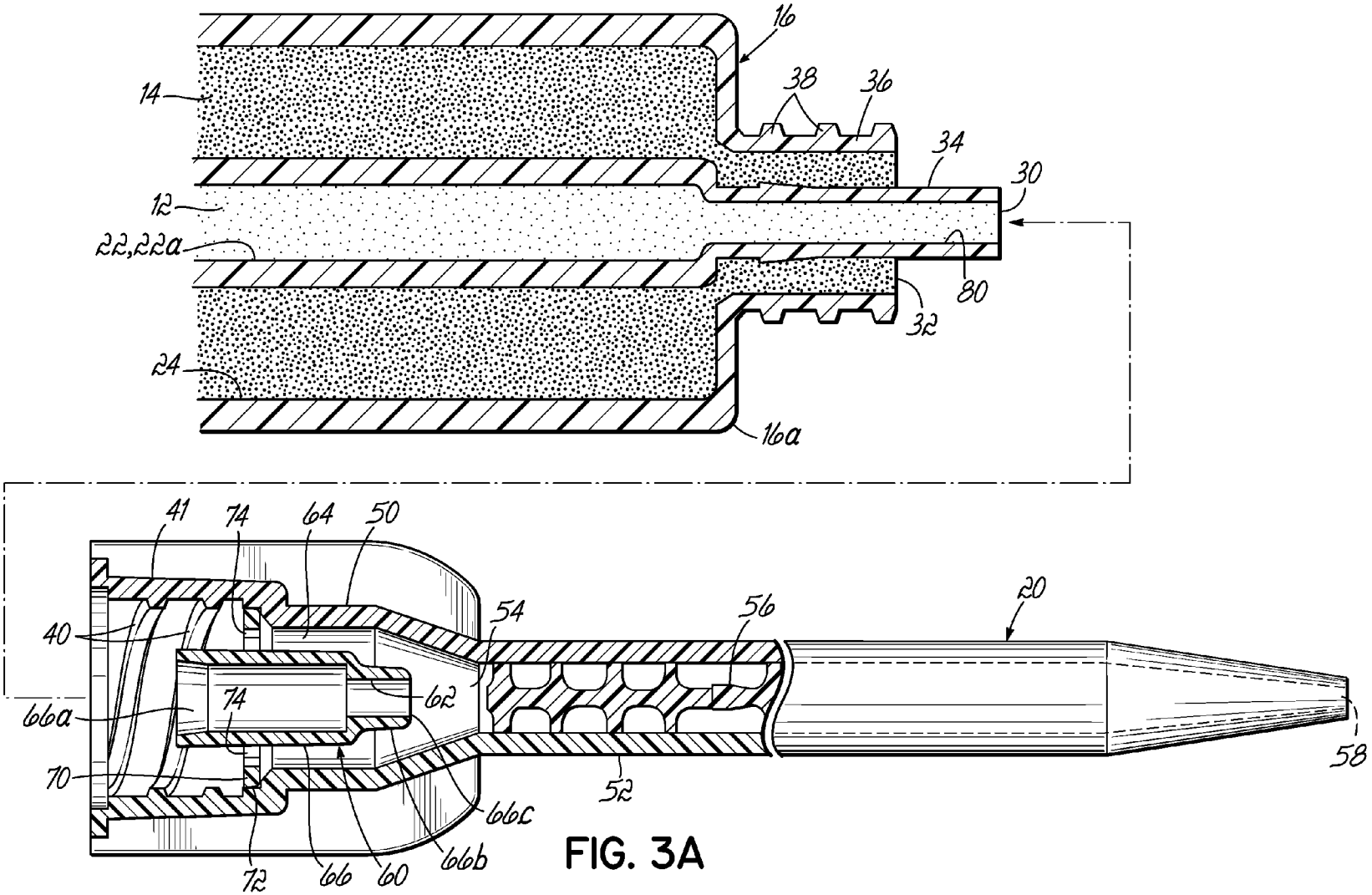
FIG. 3A is a disassembled cross sectional view more specifically illustrating the distal end of the fluid cartridge housing and the proximal portion of the static mixing nozzle.

More specifically referring to FIG. 3A, the static mixing nozzle 20 more specifically includes a first, more proximally located portion 50 attachable in a releasable manner to the distal end 16*a* of the housing 16 as described above, a second portion 52 located distal to the first portion 50, and an internal fluid passage 54 communicating between the first and second portions 50, 52. One or more static mixing elements 56 are located within the second portion 52 and a dispensing opening 58 is located at the distal tip of the second portion 52 for dispensing the mixed fluids 12, 14. A fluid separator element 60 is located in the first portion 50 and may be a separate component, as shown, or may be integrally formed with the mixing nozzle 20 such as through a plastic molding process. The fluid separator element 60 defines first and second flow passages 62, 64 through this proximal portion 50 of the mixing nozzle. In this embodiment, the first flow passage 62 is located within a central tubular portion 66 and the second flow passage 64 is located radially outside of the central tubular portion 66, and extends through a flange 70 that couples with a pressfit, for example, to an internal wall structure 72 of the mixing nozzle 20. The flange 70 includes a plurality of apertures 74 that comprise a portion of the second flow passage 64.

Figure 3B:
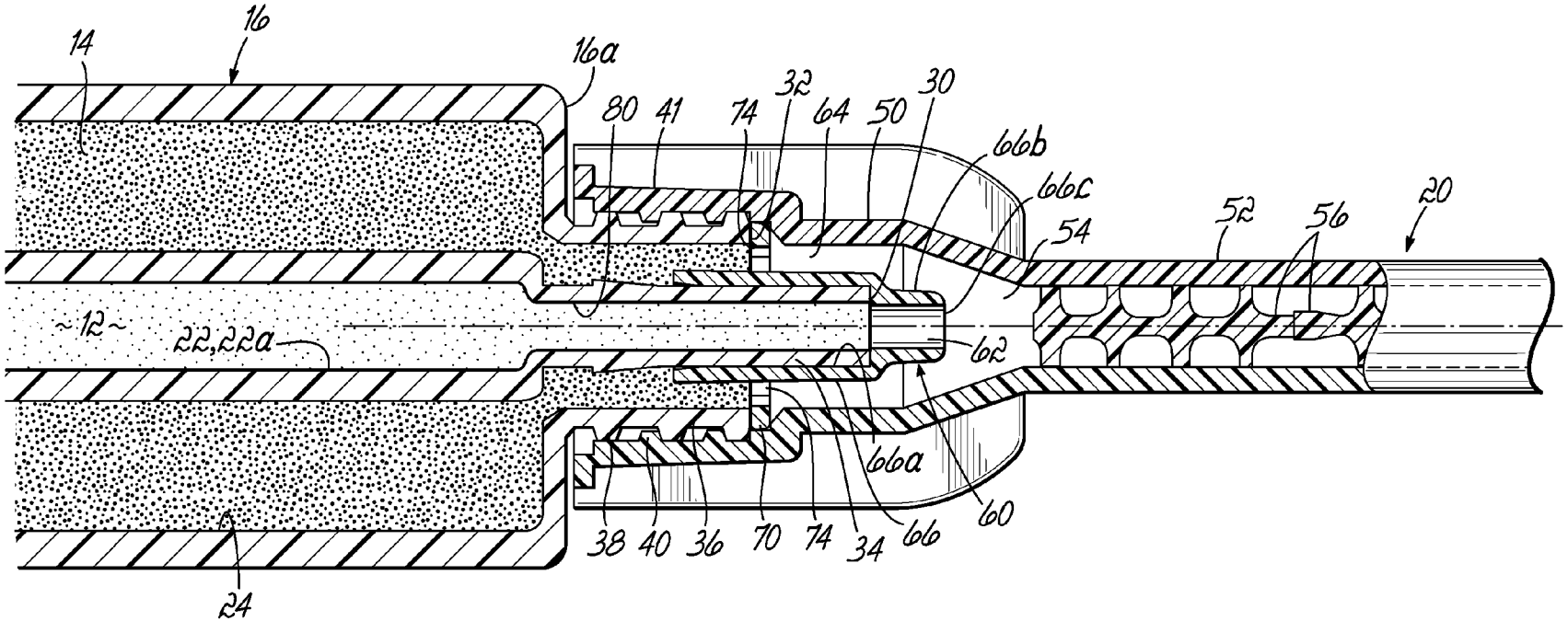
FIG. 3B is a cross sectional view similar to FIG. 3A, but illustrating an assembled condition of the cartridge housing and nozzle prior to dispensing.

As shown in FIG. 3B, the central tubular portion 66 releasably couples to the tubular outlet member 34 of the housing. Specifically, the central tubular portion 66 includes an internal cylindrical bore 66*a* sized with a diameter to receive the tubular outlet member 34 with a close, sealing friction fit as the static mixing element 20 is rotated onto the tubular outlet member 36 of the housing 16. A distal end section 66*b* of the central tubular portion 66 is necked down and includes the first flow passage 62 extending distally from the outlet 30 of the tubular outlet member 34. The first flow passage 62 has an inner diameter at least substantially equal to the inner diameter of the tubular outlet member 34.

Figure 3C:
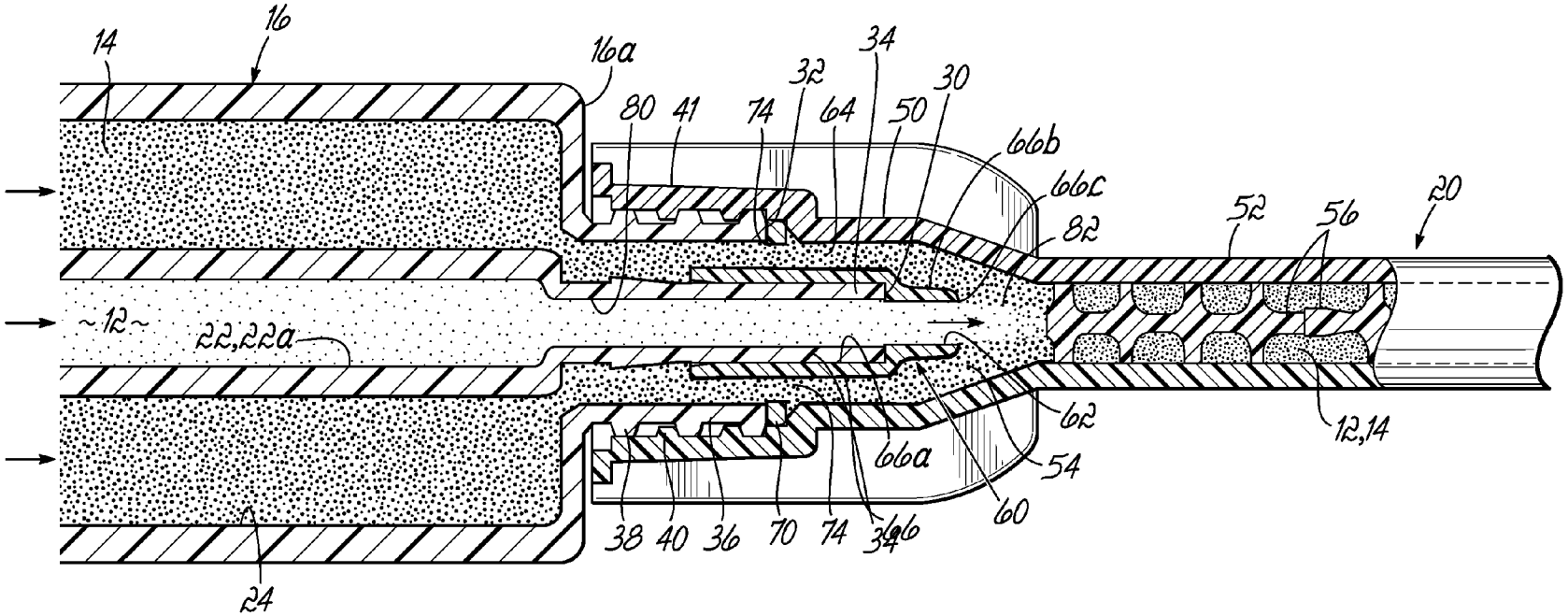
FIG. 3C is a cross sectional view similar to FIG. 3B, but illustrating the dispensing operation.
Figure 3D:
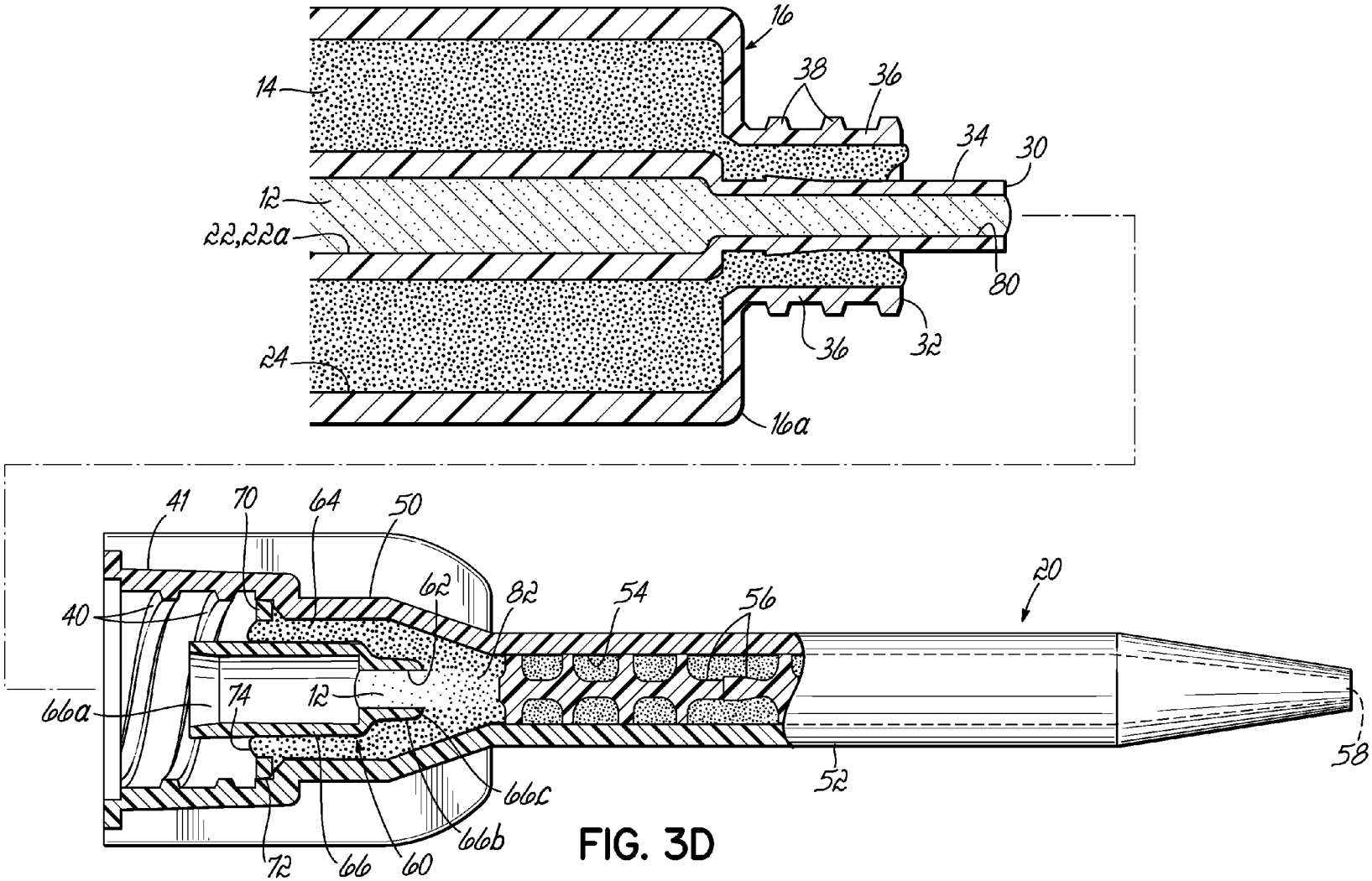
FIG. 3D is a cross sectional view similar to FIG. 3C, but illustrating the removal of the static mixing nozzle after a dispensing operation has been completed.

The operation of the fluid cartridge 10 will be best understood from a review of FIGS. 3B-3D. In FIG. 3B, the static mixing nozzle 20 has been releasably secured to the tubular outlet member 36 of the housing 16 by rotating the proximal attaching element 41 of the static mixing nozzle 20 onto the outlet portion 36 and engaging the respective threads 38, 40. This simultaneously couples the first tubular outlet member 34 within the central tubular portion 66 of the fluid separator element 60 with a fluid tight frictional fit. At this point in time, the first and second fluids 12, 14 remain in the respective first and second fluid chambers 22, 24 and do not contact one another at the respective outlets 30, 32. During the dispensing operation, the first and second fluids 12, 14 will be respectively forced in a distal direction by the pistons 42, 44 (FIG. 2). As shown in FIG. 3C, the fluids 12, 14 will travel through the outlets 30, 32 and, due to the fluid separator element 60 coupled to the tubular outlet member 34, the first and second fluids 12, 14 will maintain a physical separation until the fluids 12, 14 reach the distal tip 66*c* of the central tubular portion 66. More specifically, the first fluid 12 will travel through the flow passage 80 of the tubular outlet member 34 and into the distal end section 66*b* of the central tubular portion 66. The second fluid 14 will travel from the outlet 32 of the housing 16 through respective apertures or holes 74 in the flange 70 of the fluid separator element 60 along and within the flow passage 64 that is defined radially outside of the flow passages 62 and 80 for the first fluid 12. The two fluids 12, 14 will then contact one another at a location 82 just proximal to the static mixing element(s) 56. At this point, the two fluids 12, 14 together will enter the second or distal portion 52 of the mixing nozzle 20 and travel through the static mixing element(s) 56 where the fluids 12, 14 will be mixed and then dispensed from the dispensing opening 58. As illustrated in FIG. 3D, when the static mixing nozzle 20 is removed after a dispensing operation, the remainder of the first and second fluids 12, 14 at the outlets 30, 32 of the housing 16 are at least substantially prevented from contacting one another and potentially reacting and causing a clogged condition.

Figure 4A:
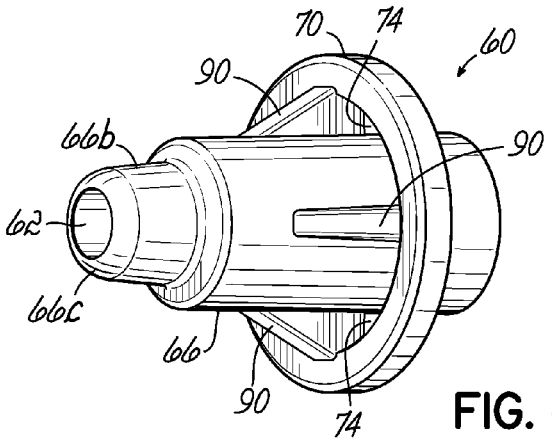
FIG. 4A is a perspective view of a fluid separator element constructed in accordance with a first illustrative embodiment.
Figure 4B:
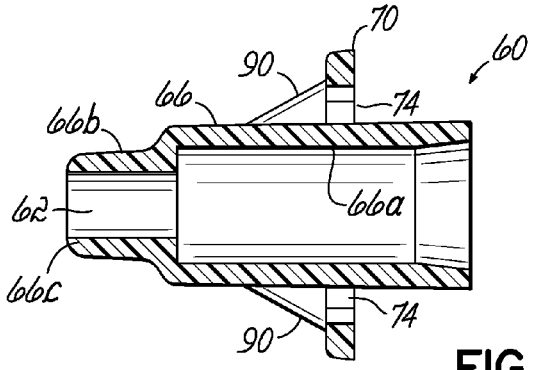
FIG. 4B is a cross sectional view taken generally along the longitudinal axis of the fluid separator element shown in FIG. 4A.
Figure 5A:
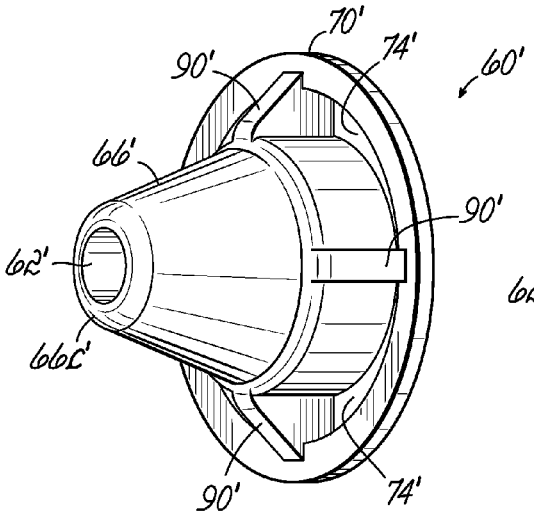
FIG. 5A is a perspective view of a fluid separator element constructed in accordance with a second illustrative embodiment.

Although the fluid separator element of the present invention may be formed in many different ways, two embodiments are illustrated respectively in FIGS. 4A and 5A. The first embodiment, more specifically shown in FIGS. 4A and 4B, is that described above and therefore unnecessary description is not repeated. Like reference numerals refer to the same elements as described above. As further shown in FIGS. 4A and 4B, the flange or annular element 70 is fixed to the central tubular portion 66 by respective ribs 90. The apertures 74 are positioned between the ribs 90 and between the central tubular portion 66 and the outer annular element or flange 70.

Figure 5B:
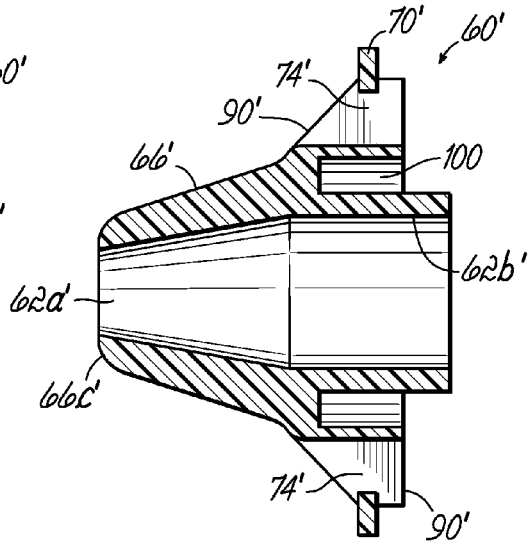
FIG. 5B is a cross sectional view taken generally along the longitudinal central axis of the fluid separator element shown in FIG. 5A.

FIGS. 5A and 5B illustrate a second embodiment of a fluid separator element 60' constructed in a similar manner to the first embodiment, but including a central tubular portion 66' that is frustoconically shaped at its distal end. It will be appreciated that in this embodiment like reference numerals with prime marks (') indicate structure that is analogous to the elements with like reference numerals described above in connection with FIGS. 4A and 4B. Element with prime marks have the same function as the elements denoted with unprimed reference numerals described above. The main difference in this second embodiment is that a portion 62*a*' of the first fluid passage is tapered toward the distal end 66*c*' so that the flow of the first fluid 12 (FIG. 2) converges in the distal direction to follow or correspond to the internal shape of the mixing nozzle. Also, the tubular fluid separator element 60' further includes an annular blind bore 100 that couples to and seals with the distal end of the fluid cartridge housing, as will be described below. A second portion 62*b*' of the fluid passage is of uniform diameter along its length.

Figure 6B:
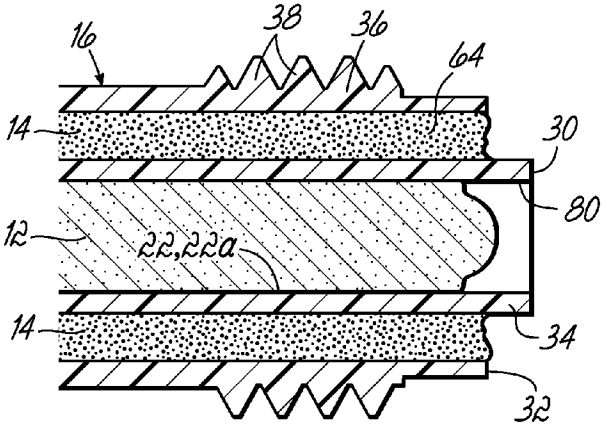
FIG. 6B is a cross sectional view similar to FIG. 6A, but illustrating the mixing nozzle removed.
Figure 6A:
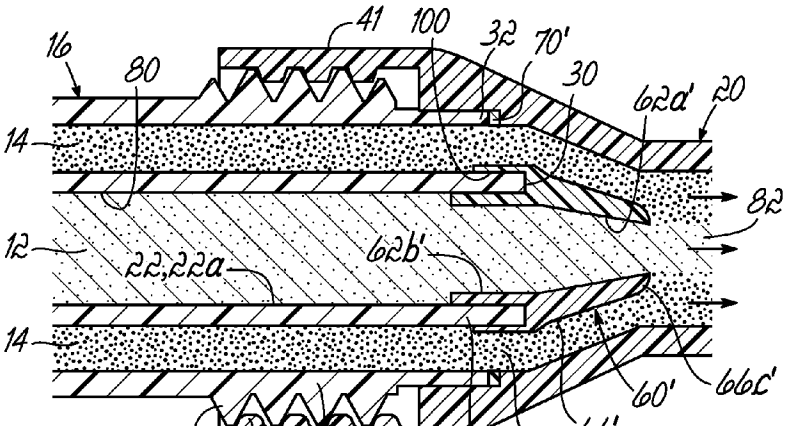
FIG. 6A is a cross sectional, fragmented view showing the interface between a mixing nozzle and the fluid cartridge housing associated with the second embodiment.
Figure 7B:
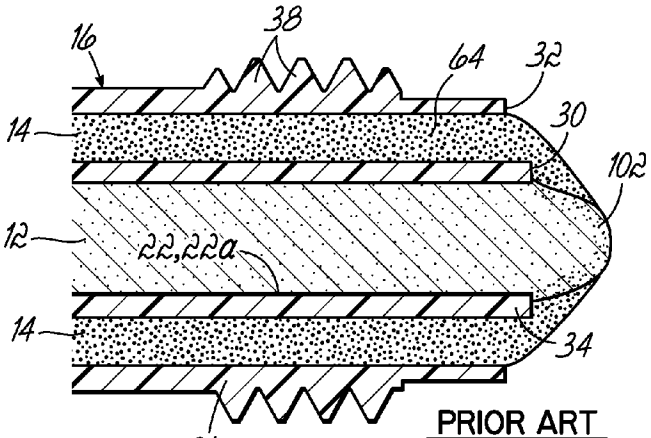
PRIOR ART FIG. 7B
FIG. 7B is a cross sectional, fragmented view similar to FIG. 7A, but illustrating the mixing nozzle removed.
Figure 7A:
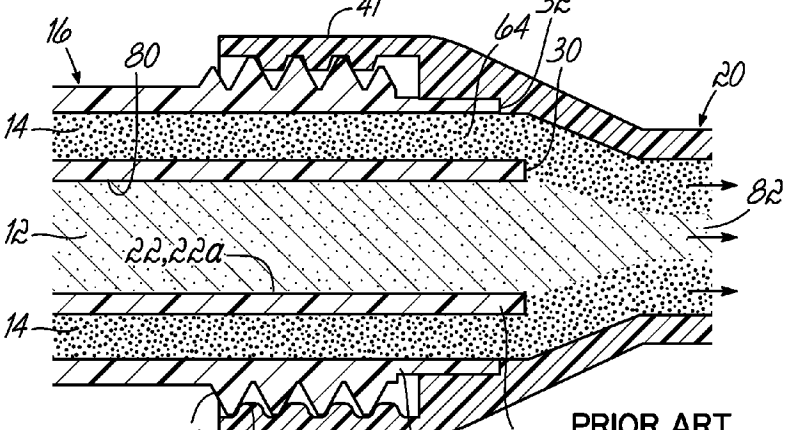
PRIOR ART FIG. 7A
FIG. 7A is a cross sectional, fragmented view similar to FIG. 6A, but illustrating the interface without the tubular fluid separating element illustrated in FIG. 6A.

FIGS. 6A and 6B illustrate advantages associated with the invention, as represented by implementation of the second embodiment. Again, like reference numerals in these figures refer to like structure and function as described above and, therefore, additional description is not necessary. As shown in FIG. 6A, the tubular fluid separator element 60' of the mixing nozzle 20 has been secured and sealed to the tubular outlet member 34. As the mixing nozzle 20 is rotated onto the distal end of the housing 16 by way of the threads 38, 40, the distal end of the tubular outlet member 34 is retained within the annular blind bore 100 with a fluid tight seal. The two fluids 12, 14 will come into contact with each other at the area 82 within the mixing nozzle 20. Thus, there is no cross-contamination at the outlets 30, 32 because the fluid separator element 60' physically separates the outlet 30 from the concentrically located outlet 32. Therefore, when the mixing nozzle 20 is removed, which may occur after the material at location 82 has co-mingled and partially or fully cured, the area of material 82 and element 60' will be taken away with the mixing nozzle 20 and the remaining material will be free of cross-contamination as shown in FIG. 6B. On the other hand, without the use of the fluid separator element 60', the situation shown in FIGS. 7A and 7B will occur. In this situation, cross-contamination occurs at location 82, once again, but this area of cross-contamination extends proximally to the respective outlets 30, 32. Therefore, when the mixing nozzle 20 is removed, this co-mingled material can create a cured or hardened area 102 that can clog the outlets 30, 32 rendering the fluid cartridge difficult to use.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. A fluid cartridge for mixing and dispensing first and second fluids, comprising:

a housing including a distal end and first and second fluid chambers configured to hold respective first and second fluids and communicating with respective first and second outlets at the distal end;

a piston unit mounted in the housing and movable to force the first and second fluids to flow from the first and second fluid chambers out of the first and second outlets; and a mixing nozzle including a first portion releasably attachable to the distal end of the housing, a second portion located distal to the first portion, an internal fluid passage communicating between the first and second portions, a static mixing element in the second portion, a dispensing opening located distal to the static mixing element, and a tubular fluid separator element in the first portion, the tubular fluid separator element defining first and second flow passages, the first flow passage contained in a central tubular portion of the tubular fluid separator element and communicating with the first outlet and the second flow passage located radially outside of the central tubular portion and communicating with the second outlet, wherein the tubular fluid separator element maintains the flow of the first fluid separate from the flow of the second fluid in the first portion of the mixing nozzle, and wherein the mixing nozzle further comprises an internal wall and the tubular fluid separator element further comprises a flange that extends from the internal wall and is positioned proximate the second outlet, the flange including the second flow passage communicating with the second outlet of the housing.

2. The fluid cartridge of claim 1, wherein the central tubular portion includes a bore that receives the first outlet.

3. The mixing nozzle of claim 2, wherein the bore further comprises an annular bore.

4. The fluid cartridge of claim 1, wherein the first flow passage is cylindrical.

5. The fluid cartridge of claim 1, wherein the first flow passage generally converges in a direction toward the second portion of the mixing nozzle.

6. A mixing nozzle adapted to be releasably coupled to a fluid cartridge for mixing and dispensing first and second fluids, the fluid cartridge including a housing with a distal end and first and second fluid chambers configured to hold respective first and second fluids and communicating with respective first and second outlets at the distal end, and the nozzle comprising:

a first portion configured to be releasably attached to the distal end of the housing;

a second portion located distal to the first portion;

an internal fluid passage communicating between the first and second portions;

a static mixing element in the second portion;

a dispensing opening located distal to the static mixing element; and a tubular fluid separator element in the first portion, the tubular fluid separator element defining first and second flow passages, the first flow passage contained in a central tubular portion of the tubular fluid separator element and adapted to be coupled for communication to the first outlet and the second flow passage located radially outside of the central tubular portion and adapted to be coupled for communication with the second outlet, wherein the fluid separator element maintains the flow of the first fluid separate from the flow of the second fluid in the first portion of the mixing nozzle, wherein the mixing nozzle further comprises an internal wall and the tubular fluid separator element further comprises a flange that extends from the internal wall and is configured to be positioned proximate the second outlet, the flange including the second flow passage adapted to communicate with the second outlet of the housing.

7. The mixing nozzle of claim 6, wherein the central tubular portion includes a bore configured to receive the first outlet.

8. The mixing nozzle of claim 7, wherein the bore further comprises an annular bore.

9. The mixing nozzle of claim 6, wherein the first flow passage is cylindrical.

10. The mixing nozzle of claim 6, wherein the first flow passage generally converges in a direction toward the second portion of the mixing nozzle.

11. A method for mixing and dispensing first and second fluids from a nozzle adapted to be releasably coupled to a fluid cartridge, the fluid cartridge including a housing with a distal end and first and second fluid chambers configured to hold respective first and second fluids and communicating with respective first and second outlets at the distal end, and the method comprising:

releasably coupling a first portion of a mixing nozzle to the distal end of the housing;

forcing the first and second fluids from the first and second outlets into the first portion of the mixing nozzle;

directing the first fluid through a central tubular portion of a tubular fluid separator element;

directing the second fluid along a path radially outside of the central tubular portion and through a flow passage in a flange, the flange extending between the central tubular portion and an internal wall of the mixing nozzle and positioned proximate the second outlet, to maintain the first and second fluids physically separated at a location distal to the first outlet;

delivering the first and second fluids through a static mixing element in a second portion of the mixing nozzle located distal to the first portion;

mixing the first and second fluids with the static mixing element; and discharging the mixed first and second fluids through a dispensing opening located distal to the static mixing element.

12. The method of claim 11, further comprising:

removing the mixing nozzle and fluid separator element from the housing with the first and second fluids remaining separated.

13. The method of claim 12, wherein the first outlet of the housing further comprises a tubular outlet member, and releasably coupling the first portion of a mixing nozzle to the distal end of the housing further comprises:

releasably coupling the central tubular portion to the tubular outlet member.

14. The method of claim 13, wherein the central tubular portion includes a bore and releasably coupling the central tubular portion to the tubular outlet member further comprises:

inserting the tubular outlet member into the bore with the central tubular member extending distally from the tubular outlet member.

15. The method of claim 11, wherein maintaining the first and second fluids physically separate from each other further comprises:

directing the first fluid through a converging flow passage in the central tubular portion of the tubular fluid separator element.

16. The fluid cartridge of claim 1, wherein the central tubular portion of the fluid separator element includes a tip distal from the first outlet, and a fluid contacting space is defined between the tip and the static mixing element of the mixing nozzle, the fluid contacting space being configured for the first and second fluids to contact one another before contacting the static mixing element.

17. The fluid cartridge of claim 1, wherein the fluid separator element is in non-contacting relationship with the static mixing element.

18. The mixing nozzle of claim 6, wherein the central tubular portion of the fluid separator element includes a tip distal from the first outlet, and a fluid contacting space is defined between the tip and the static mixing element of the mixing nozzle, the fluid contacting space being configured for the first and second fluids to contact one another before contacting the static mixing element.

19. The mixing nozzle of claim 6, wherein the fluid separator element is in non-contacting relationship with the static mixing element.

20. The fluid cartridge of claim 1, wherein the flange of the tubular fluid separator element includes a plurality of apertures, and wherein the flange is frictionally engaged with the internal wall of the mixing nozzle such that when the mixing nozzle is attached to the housing, the flange blocks flow of the second fluid from the second outlet except through the plurality of apertures.

21. The fluid cartridge of claim 1, wherein the tubular fluid separator element includes a distal end, and wherein the distal end is spaced from and located distally from the flange of the tubular fluid separator element so as to define an elongate annular space between the flange and the distal end to define a part of the second flow passage.

22. The fluid cartridge of claim 1, wherein the flange of the tubular fluid separator element is sandwiched between the first portion of the mixing nozzle and the distal end of the housing when the mixing nozzle is releasably attached to the housing.

* * * * *